US008047295B2

(12) United States Patent
Skeels et al.

(10) Patent No.: US 8,047,295 B2
(45) Date of Patent: Nov. 1, 2011

(54) LIGHTWEIGHT DEVICE FOR REMOTE SUBSEA WIRELINE INTERVENTION

(75) Inventors: Brian Skeels, Kingwood, TX (US); Hans Jørgen Lindland, Sandnes (NO); Olav Inderberg, Kongsberg (NO); Bjørn Jahnsen, Oslo (NO)

(73) Assignee: FMC Technologies, Inc., Houston, TX (US)

( * ) Notice: Subject to any disclaimer, the term of this patent is extended or adjusted under 35 U.S.C. 154(b) by 999 days.

(21) Appl. No.: 11/757,822

(22) Filed: Jun. 4, 2007

(65) Prior Publication Data

US 2008/0264643 A1 Oct. 30, 2008

(30) Foreign Application Priority Data

Apr. 24, 2007 (NO) ..... 20072118

(51) Int. Cl.
*E21B 29/12* (2006.01)

(52) U.S. Cl. ..... 166/348; 166/338; 166/339; 166/340

(58) Field of Classification Search ..... 166/368, 166/363, 364, 338, 339, 340, 97.1, 85.1, 166/77.2, 77.1
See application file for complete search history.

(56) References Cited

U.S. PATENT DOCUMENTS 3,242,991 A 3/1966 Johnson et al. ..... 166/75
3,441,084 A * 4/1969 Fredd ..... 166/250.01
3,448,803 A * 6/1969 Sizer ..... 166/115
3,501,173 A * 3/1970 Linder et al. ..... 285/114
3,517,738 A 6/1970 Petersen ..... 166/0.6
3,568,767 A * 3/1971 Weiss ..... 166/351
3,762,725 A * 10/1973 Taylor ..... 277/330
3,831,676 A * 8/1974 Brown et al. ..... 166/84.2
3,924,686 A * 12/1975 Arnold ..... 166/385
4,386,783 A 6/1983 Davis ..... 277/73

(Continued)

FOREIGN PATENT DOCUMENTS

GB 1 286 055 6/1971

(Continued)

OTHER PUBLICATIONS

PCT Search Report and Written Opinion from PCT/US2008/059226 dated Oct. 7, 2008.

*Primary Examiner* — Thomas Beach
*Assistant Examiner* — James Sayre
(74) *Attorney, Agent, or Firm* — Williams, Morgan & Amerson, P.C.

(57) ABSTRACT

In one illustrative embodiment, the present invention is directed to a device adapted to be positioned adjacent an end of a tool housing of a subsea lubricator, wherein the device includes a structural member that is adapted to be positioned adjacent an end of the tool housing, a non-metallic body coupled to the structural member and a sealing device that is adapted to sealingly engage a wireline extending through the sealing device. The present invention is also directed to a method which includes lowering an assembly toward a tool housing of a subsea lubricator positioned subsea using a wireline for the tool to support a weight of the assembly, wherein the assembly includes a wireline tool and a device including a structural member that is adapted to be positioned adjacent the end of a tool housing, a non-metallic body coupled to the structural member, and a sealing device that is adapted to sealingly engage a wireline extending through the sealing device.

21 Claims, 8 Drawing Sheets

U.S. PATENT DOCUMENTS

| | | | | |
|---|---|---|---|---|
| 4,673,041 | A | 6/1987 | Turner et al. | 166/340 |
| 4,681,168 | A * | 7/1987 | Kisling, III | 166/381 |
| 4,706,744 | A * | 11/1987 | Smith et al. | 166/65.1 |
| 4,825,953 | A * | 5/1989 | Wong et al. | 166/338 |
| 4,993,492 | A * | 2/1991 | Cressey et al. | 166/339 |
| 5,893,417 | A | 4/1999 | Pizzolato | 166/377 |
| 5,992,526 | A | 11/1999 | Cunningham | 166/343 |
| 6,102,125 | A * | 8/2000 | Calder | 166/359 |
| 6,105,939 | A | 8/2000 | Vance et al. | 254/405 |
| 6,142,233 | A * | 11/2000 | Wilkins | 166/339 |
| 6,179,053 | B1 * | 1/2001 | Dallas | 166/77.51 |
| 6,412,560 | B1 * | 7/2002 | Bernat | 166/301 |
| 6,591,913 | B2 * | 7/2003 | Reaux et al. | 166/352 |
| 6,827,147 | B2 * | 12/2004 | Dallas | 166/379 |
| 6,843,321 | B2 | 1/2005 | Carlsen | 166/355 |
| 6,913,084 | B2 * | 7/2005 | Boyd | 166/385 |
| 7,063,157 | B2 | 6/2006 | Bartlett | 166/339 |
| 7,114,571 | B2 | 10/2006 | Gatherar et al. | 166/367 |
| 7,308,943 | B2 * | 12/2007 | Hopper et al. | 166/348 |
| 7,392,864 | B2 * | 7/2008 | McGuire et al. | 175/423 |
| 7,584,798 | B2 * | 9/2009 | Dallas | 166/383 |
| 2003/0221844 | A1 | 12/2003 | Dallas | 166/381 |
| 2005/0103123 | A1 * | 5/2005 | Newman | 73/862.045 |
| 2006/0124314 | A1 | 6/2006 | Haheim et al. | 166/368 |
| 2008/0110613 | A1 | 5/2008 | Holte et al. | 166/84.2 |
| 2008/0277122 | A1 * | 11/2008 | Tinnen | 166/339 |

FOREIGN PATENT DOCUMENTS

| | | | |
|---|---|---|---|
| WO | WO 01/25593 | A1 | 4/2001 |
| WO | WO 2005/103440 | A2 | 11/2005 |
| WO | WO 2006/003477 | A2 | 1/2006 |
| WO | WO 2006/030186 | A1 | 3/2006 |
| WO | WO 2006/096069 | A1 | 9/2006 |

* cited by examiner

LIGHTWEIGHT DEVICE FOR REMOTE SUBSEA WIRELINE INTERVENTION

BACKGROUND OF THE INVENTION

1. Field of the Invention

The present invention is generally directed to the field of subsea oil and gas production, and, more particularly, to a lightweight device for remote subsea wireline intervention.

2. Description of the Related Art

Offshore oil and gas wells may generally be divided into two groups—surface piercing wells and subsea wells. Surface piercing wells are wells that are located on an artificial surface above sea level that is supported by a fixed structure, e.g., a platform, or a floating structure, e.g., a spar, a semi-submersible, a tension leg platform, a vessel, etc. Subsea wells reside on the sea floor, including their wellhead structure and valving control (subsea Christmas tree).

Often during the life of a well, intervention into the well bore may be required for a variety of reasons. For example, an intervention may be required to diagnose a problem, correct a problem, stimulate production and/or repair equipment within the well bore. Performing intervention operations on surface piercing wells is very straightforward as surface piercing wells are easily accessed through the top of the Christmas tree (located on the artificial surface) using traditional means developed for land-based wells, e.g., a lubricator, pressure containment assembly (wireline rams), and one or more lifting devices. Such operations can be performed at a relatively low cost due to the ready accessibility to the top of the Christmas tree on such surface piercing wells and the equipment used in performing such interventions.

However, intervention on subsea wells is much more difficult and expensive. Intervention of a subsea well frequently requires the rental and use of a surface vessel, a completion/workover riser, and both surface and subsea pressure containment assemblies (a surface tree that mimics a surface piercing Christmas tree—so that workover hardware can be attached, and a Lower Workover Riser Package (LWRP) 5—e.g. a lower riser package (LRP 5A) with actuated pressure containment rams, and an emergency disconnect package (EDP) for well control to gain surface access to the subsea Christmas tree. Equipment used in such subsea intervention projects may not be readily available and they are much more expensive than their land-based counterparts. Moreover, intervention on a subsea well is much more complex and involved as compared to intervention projects on surface piercing wells. Thus, intervention on subsea wells may be delayed or not performed at all, or the subsea wells may simply be allowed to operate inefficiently.

So-called lightweight intervention was initially introduced in the North Sea in an effort to increase accessibility and reduce the costs associated with intervention of a subsea well. Generally, as shown in FIG. 1, lightweight well intervention involves the use of a relatively smaller work vessel 1 with moderate lifting capacity to go to the offshore site and lower a Lightweight Intervention Package (LIP) 5 on guidelines down to the subsea tree 4 that is coupled to a well 10 at the floor 3. The LIP 5 may include a Lower Riser Package (LRP 5A) 5A (similar to the LRP 5A mentioned above for the completion workover riser), a subsea lubricator 5B and pressure control head (PCH) 5C end connection, provided to accomplish the same intervention jobs with respect to the well, but entering thorough a subsea pressure containment mechanism (subsea lubricator) as opposed to using a surface lubricator and conduit (completion/workover riser) extending from the vessel all the way to the Christmas tree on the sea floor. Also depicted in FIG. 1 is a drum 13 for wireline 9 that is employed to operate or retrieve data from a tool (not shown) to be positioned within the well 10. For subsea lightweight well intervention, the drum 13 and the wireline 9 are used to lower a wireline tool from the surface to the subsea lubricator 5B and to retrieve the wireline tool after the well intervention is completed. The vessel 1 also comprises drums 14 and 17 for umbilical control lines 7 and 16, respectively. The umbilical line 7 may be employed to supply hydraulic and/or electrical power to the LIP equipment (and possibly the subsea Christmas tree) positioned above the subsea tree 10. This umbilical line 7 may also be employed to supply circulating fluids for well control and/or treatment chemicals needed during the well intervention. The umbilical line 16 is employed to control an illustrative remotely operated vehicle (ROV) 15 which may be employed to perform a variety of subsea operations well known to those skilled in the art. One or more extra lines (not shown) from the vessel may be employed to guide various structures or components to the sea floor.

When performing an intervention in a hydrocarbon well it is necessary to isolate the well from the environment. When performing intervention operations on a subsea well 10 using wireline techniques (braided wire, composite cable or slickline), pressure in the well during operations must be contained and structures must be employed to prevent or reduce hydrocarbons from escaping into the surrounding environment. To achieve these objectives, intervention operations involve the use of an isolation control device (lower riser package—LRP) 5A, a pressure control head (PCH) 5C and a lubricator 5B. The PCH 5C provides a dynamic seal between the cable 9 and the wellbore enclosures to maintain pressure control and prevent wellbore fluids from leaking into the environment. The lubricator 5B is a length of pipe that is used to hold a tool during insertion and withdrawal from the well 10, and the isolation control device (LRP) 5A controls the environment between the lubricator 5B and the rest of the well.

At the start of such a process, the LRP 5A and the lubricator 5B are lowered to the well 10 and retrieved therefrom by wire rope (not shown) or by drill pipe. Guidance and alignment of equipment may be done with the use of one or more guidelines (not shown) that are well known to those skilled in the art. After the LRP 5A and subsea lubricator 5B are secured to the subsea Christmas tree 4, a wireline deployed tool (not shown) may be employed to enter the well 10 via a simple wireline 9 intervention. During such a process, the tool is lowered to the well 10 and retrieved therefrom by the same wire 9 that will eventually lower the wireline tool up and down inside the well. The ROV 15 may provide added assistance (in addition to the guidelines) to align the wireline tool with the topmost entry point of the lubricator 5B. Once the tool is safely inside the lubricator cavity, a stuffing box, or pressure control head (PCH) is lowered by a separate wire rope or drill pipe until the PCH 5C reaches the entry point of the lubricator 5B. Then, the PCH's connector is remotely locked and provides a pressure-tight seal over the entry to the lubricator 5B. After connection, the lubricator 5B and stuffing box assembly may be pressure tested to assure proper connection and well control containment. This is followed by opening the valves in the subsea Christmas tree 4 to allow the wireline tool access into the well under a pressure controlled condition. The PCH 5C assembly contains a packing arrangement containing one or more seals which allows the wireline 9 to pass therethrough and the wireline tool is raised or lowered into the well. After the well intervention is completed, the tool is pulled up via the wireline 9 back into the lubricator cavity and the tree and LRP valves are closed. This is followed by evacuating any residual well fluids trapped in the lubricator 5B and replacing them with sea water and the pressure equalized to ambient conditions using a plurality of hydraulic line conduits (leading to the control umbilical) to circulate fluids in and out of the lubricator cavity. Afterwards, the PCH 5C is unlocked from the end of the lubricator 5B and the PCH 5C is hoisted back to the surface vessel.

Normally, the lubricator consists of a number of pipes that are made up together permanently on the vessel to the desired length. The PCH 5C is releasably connected to the top of the lubricator. In normal operations, a BOP is first lowered from the vessel and connected to the top of the Christmas tree 4. The lubricator 5B is lowered and connected to the BOP.

The cable or wireline 9 is inserted through the PCH 5C and then the tool is attached to the cable end. The PCH 5C is arranged so that the cable or wireline 9 can slide through the PCH 5C while the PCH 5C maintains a seal around the cable or wireline 9, as is well known in the art. Now the whole assembly can be lowered towards the well by paying out the cable or wireline from the drum 13 on the vessel. As the assembly reaches the lubricator stack on the seabed, the tool enters into the lubricator 5B. Further lowering of the assembly brings the PCH 5C into contact with the top of the lubricator 5B. A mechanical connector (not shown) is used to releasably lock the PCH 5C and the lubricator 5B together. The tool is now inside the lubricator. To lower the tool into the well, the valves in the BOP are opened and additional cable 9 is played out so that the tool is lowered into the well. The PCH 5C seals around the cable 9 during the operation, thus acting as a barrier against the well pressure.

If multiple wireline interventions are required on the wireline, the wireline tool is redressed or exchanged with another tool at the surface and the tool is redeployed to the subsea lubricator 5B; followed by redeployment/connection of the PCH 5A. If the job is complete, the LRP 5A and lubricator 5B are separately retrieved from the well 10, using wire rope (not shown) or drill pipe.

The use of all of these hoisting wire ropes, guidelines, etc. is envisioned as becoming more difficult as water depth increases. Such an operation with multiple guidelines, equipment and wire rope can be cumbersome. More specifically, handling the wire rope and the multiple guidelines results in fouling problems that the crew of the workover vessel must deal with, to a point where operations become inefficient or more difficult to perform.

The lubricator 5B will behave as a vertical column and be affected by forces of current and other producing bending stresses. The length of the lubricator 5B is limited by tower or crane lifting height restrictions. The length of the lubricator 5B should therefore be as short as possible but must necessarily be longer than the tool to be able to hold the tool before going in or after coming out of the well. This is a limitation that limits the use of riserless well intervention to tools shorter than about 20 meters. However, some operations may require a longer tool than normal tools and today the practice is to use standard riser for operations requiring longer tools. Examples of such tools are perforating guns and straddle packers that may be up to 40 meters long. Since operations involving risers are far more costly than riserless techniques it is desirable to find means of extending the scope of wireline operations. As shown in FIGS. 8 and 9 and described herein, a subsea lubricator stack is depicted as the tool 440 is lowered onto the stack prior to insertion into the well.

The present invention is directed to various devices and methods for solving, or at least reducing the effects of, some or all of the aforementioned problems.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

In one illustrative embodiment, the present invention is directed to a device adapted to be positioned adjacent an end of a tool housing of a subsea lubricator, wherein the device comprises a structural member that is adapted to be positioned adjacent an end of the tool housing, a body coupled to the structural member and a sealing device that is adapted to sealingly engage a wireline extending through the sealing device. In some embodiments, the body may be comprised of a non-metallic material or a material having a density less than that of steel or other similar materials. In some cases, the sealing device may comprise a stuffing box design or a grease injection system.

In another illustrative embodiment, a method is disclosed which comprises lowering an assembly toward a tool housing of a subsea lubricator positioned subsea using a wireline for the tool to support a weight of the assembly, wherein the assembly comprises a wireline tool and a device comprising a structural member that is adapted to be positioned adjacent the end of a tool housing, a body coupled to the structural member, and a sealing device that is adapted to sealingly engage a wireline extending through the sealing device.

In one example, a single wireline is employed to hoist and lower the combination of a wireline tool and a sealing device that will be operatively coupled to the subsea lubricator. Such an assembly may be lowered to the sea floor using guidelineless techniques well known to those skilled in the art. An ROV may provide additional assistance to align the wireline tool with the topmost entry point of the subsea lubricator. Once the tool is safely inside the lubricator cavity, the assembly is lowered further until the sealing device reaches the entry point of the subsea lubricator. Then, an ROV may be employed to activate a connector assembly which locks the sealing device to the subsea lubricator and provides a pressure-tight seal over the lubricator entry. After connection, the lubricator and sealing device assembly may be pressure tested to assure proper connection and well control containment. This is followed by opening the valves of the subsea Christmas tree to allow the wireline tool access into the well under a pressure controlled condition. The sealing device may contain a packing arrangement containing one or more seals which allows the wireline to pass therethrough. After the well intervention is completed, the wireline tool is retrieved, via the wireline, back into the lubricator cavity and the tree and the LRP valves are closed. This is followed by evacuating any residual well fluids trapped in the lubricator and replacing them with sea water and the pressure equalized to ambient conditions using a plurality of hydraulic line conduits (leading to the control umbilical) to circulate fluids in and out of the lubricator cavity. Afterwards, the sealing device may be unlocked from the end of the lubricator and the combination of the wireline tool and the sealing device may be hoisted back to the surface vessel using the single wireline.

If multiple wireline interventions are required, the wireline tool may be redressed or exchanged with another tool at the surface and both the tool and sealing device may be redeployed to the subsea lubricator using the same technique as described above. If the job is complete, the LIP may be separately retrieved from the well, using wire rope (not shown) or drill pipe. This approach described herein may save time and reduce the number of lines in the water by eliminating the separate deployment and recovery of the sealing device.

BRIEF DESCRIPTION OF THE DRAWINGS

The invention may be understood by reference to the following description taken in conjunction with the accompanying drawings, in which like reference numerals identify like elements, and in which.

Figure 1:
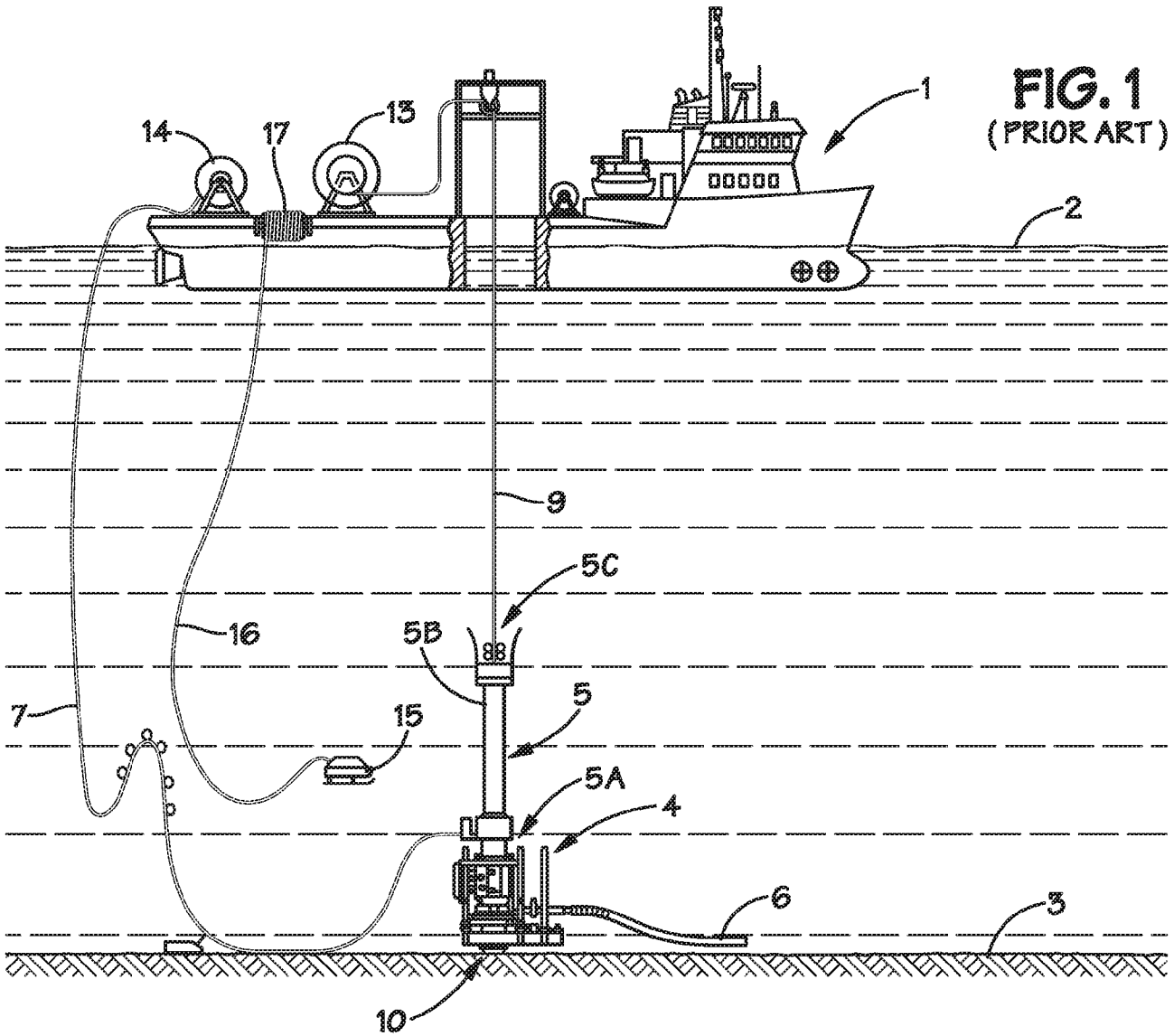
FIG. 1 (PRIOR ART)
FIG. 1 is an illustrative example of a prior art intervention of a subsea well.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2:
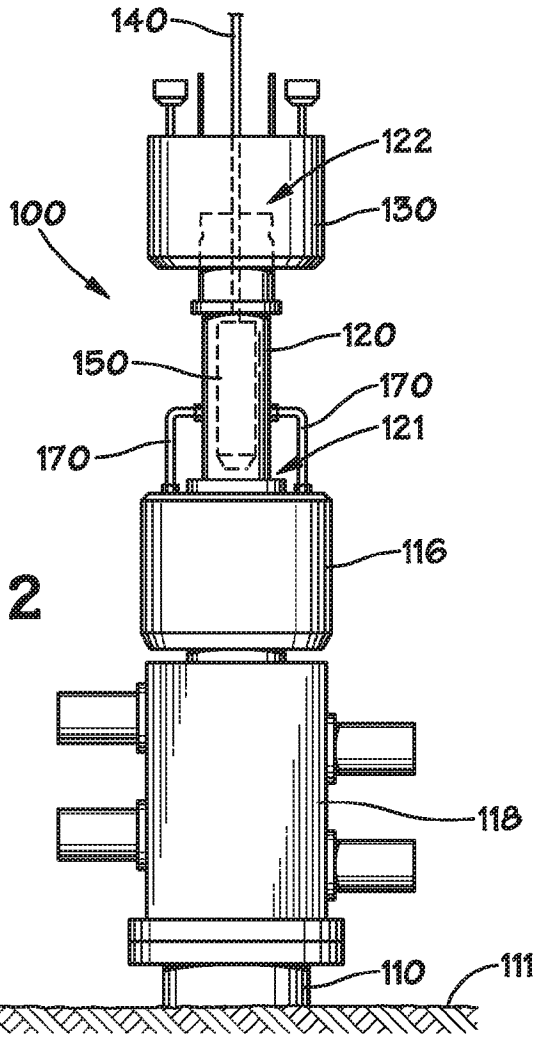
FIG. 2 depicts one illustrative embodiment of an assembly that includes the device of the present invention.

FIG. 2 schematically depicts one illustrative embodiment of a system 100 in accordance with one aspect of the present invention. Depicted therein is an illustrative subsea well 110 positioned adjacent a sea floor 111. A schematically depicted subsea Christmas tree 118 is operatively coupled to the well 110 using known techniques. A lightweight intervention package (LIP) 116 is operatively coupled to the Christmas tree 118 using known techniques and methods. As stated above, the subsea Christmas tree 118 and lightweight intervention package (LIP) 116 are intended to be representative in nature. That is, they schematically depict any of a variety of different structures that may be operatively coupled to the well 110. For example, the subsea Christmas tree 118 typically comprises a plurality of valves that are used in controlling the production from the well 110. The subsea Christmas tree 118 may be of any desired shape or configuration, e.g., horizontal, vertical, etc. Similarly, the lightweight intervention package (LIP) 116 is intended to generically represent any type of equipment that may be operatively coupled to the well 110 during an intervention process. For example, the LIP 116 may be:

- a tree running tool connector, an isolation valve and a lubricator tube,
- a tree running tool, a lower riser package (LRP 5A) consisting of a set of wire cutting/sealing valves (or other sealing devices), crossover/circulation valves, and a lubricator tube attached above, or
- a completion workover riser with a lightweight riser package "LWRP" (a tree running tool, LRP 5A, and emergency disconnect package (EDP) connected together). The connection point between the LRP 5A and EDP can be interchangeable between a lubricator assembly and a completion/workover riser stress joint and conduit pipe.

Additionally, it should be understood that FIG. 2 is also representative in that additional components, e.g., a tubing head, or flow spools to ancillary equipment, may be positioned between some of the components depicted in FIG. 2. For example, a tubing head (not shown) may be positioned between the subsea well 110 and the subsea Christmas tree 118. Other items of subsea equipment may be operatively coupled to the well 110 in a variety of different configurations. Thus, the illustrative equipment depicted in FIG. 2, and the arrangement thereof, should not be considered a limitation of the present invention.

As shown in FIG. 2, one end 121 of a subsea lubricator housing 120 is operatively coupled to the LIP 116. A sealing device 130 in accordance with one illustrative embodiment of the present invention is operatively coupled to the other end 122 of the lubricator housing 120. An illustrative wireline tool 150 (shown in dashed lines) is positioned within the cavity defined by the lubricator housing 120 and coupled to a wireline 140. As described more fully below, the sealing device 130 comprises means for sealing around the wireline 140 so as to prevent or reduce the escape of hydrocarbon fluids from the lubricator housing 120 during use of the device. Also schematically depicted in FIG. 2 are a plurality of fluid connections 170 between the lubricator housing 120 and the LIP 116.

In accordance with one aspect of the present invention, the lubricator housing 120 may be coupled to the LIP 116 at the surface and installed above the subsea Christmas tree 118 using a lift rope (not shown) or drill pipe (not shown) that is of sufficient strength to support the combined weight of the LIP 116 and the lubricator housing 120. For example, the combined weight of the LIP 116 and the lubricator housing 120 may range from approximately 150,000-200,000 pounds, depending upon the particular application. Additionally, in another aspect of the present invention, the fluid connections 170 between the lubricator housing 120 and the rest of the LIP 116 may be established at the surface as the lubricator housing 120 and the LIP 116 may be configured together prior to the combination of the lubricator housing and the LIP 116 being lowered toward the well 110.

The lubricator housing 120 may be permanently or removably coupled to the LIP 116 depending upon the particular application and the need to simplify surface handling of the LIP 116. For example, the lubricator housing 120 may be assembled as an integral part of one or more components that comprise the LIP 116. If desired, the lubricator housing 120 may be removably coupled to the LIP 116 by a bolted or clamped connection. Additionally, it should be understood that an intermediate structure, such as a spool, may be positioned between the LIP 116 and the actual lubricator housing 120. Nevertheless, in such an arrangement, it will be understood that the lubricator housing 120 is operatively coupled to the LIP 116.

The lubricator housing 120 may be of traditional size, configuration and construction, e.g., it may be made of steel or other metals. Of course, the particular details of construction and dimensions of the lubricator housing 120 may vary depending upon the particular application. As will be understood by those skilled in the art after a complete reading of the present application, the lubricator housing 120 has a cavity that is adapted to receive the wireline tool 150. The wireline tool 150 may be any type of tool or device that may be employed in performing an intervention in the well 110. For example, the wireline tool 150 may be a pressure/temperature sensor, a plug installation/retrieval tool, a caliper measurement tool, a downhole camera, a whipstock diverter, a side pocket kickover tool, etc. A wireline 140 may also be employed with the present invention to lower or retrieve the tool 150 and other downhole devices (not shown) such as a gas lift valve, a tubing plug, storm choke, as a combined unit. The device described herein may also be employed with a so-called downhole "tractor," a locomotive mechanism that can drive the wireline tool 150 further into the well 110, especially in instances where the well's inclination goes from near vertical to near horizontal. All these configurations will dictate the cavity diameter and overall length of the lubricator housing 120.

The sealing device 130 comprises a means for sealing around the wireline 140 to prevent or limit the amount of well fluids (including hydrocarbons) from escaping to the environment from the point where the wireline 140 exits the lubricator housing 120 when intervention operations are performed. As described more fully below, the sealing device 130 may be of any structure that is capable of performing this function. For example, the sealing device 130 may comprise a stuffing box or a grease injection assembly to provide the necessary seal around the wireline 140 during operations. Of course, it should be understood that through use of the term sealing device, applicant does not mean to imply that the seal established between the wireline 140 and the sealing device is absolutely liquid tight (although it may be in some cases). Rather, the sealing device 130 described herein provides at least an appropriate level of sealing as is commonly accepted using traditional devices or arrangements such as a stuffing box or a grease injection device to seal around wirelines that are employed in well intervention operations. An illustrative grease injection system may be employed as the sealing device 130 to help seal around an irregular wireline surface, most notably the "wire rope" braided exterior of a braided wireline cable. In such a system, the grease is injected into the crevices and voids between the wire strands to assist in sealing between the cable body and the seal elements. However, when the wireline 140 has a smooth exterior surface of a traditional "slickline" or composite cable 140 shown in FIG. 3, the need for using a grease injection system as the sealing device 130 may not be required. In the case where the wireline 140 has a relatively smooth exterior surface, a stuffing box type design may be employed as the sealing device 130. In such a situation, the sealing elements (not shown) within such a stuffing box may not have to be changed out during operations, e.g., during multiple wireline runs.

Figure 3:
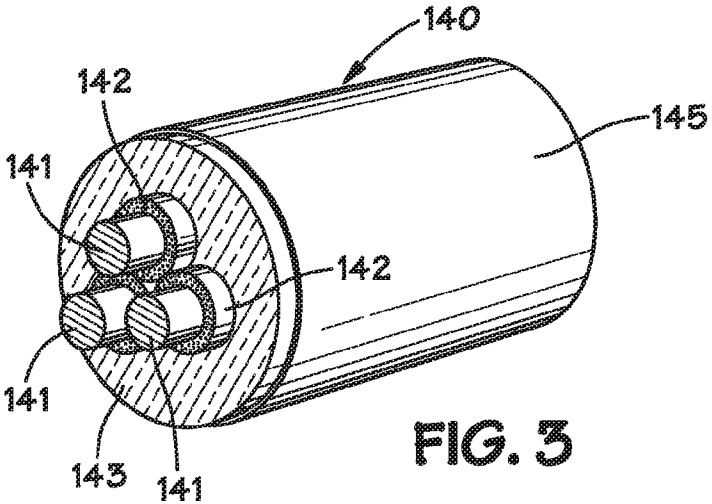
FIG. 3 depicts an illustrative embodiment of a wireline that may be employed with the present invention.

One illustrative embodiment of the wireline 140 that may be employed with the present invention is shown in FIG. 3. Current art consist of wirelines with a single steel core strand (often referred to as slickline) of various diameters bare, or with an insulating external sleeve, or a braided cable with an electrical cable core (of one or more electrical or fiber optic conduits) surrounded by a plurality of external helically wound wire strands for mechanical tensile strength and armor protection of the electrical cable core. However, the illustrative wireline 140 depicted herein may comprise a composite cable having an outer diameter of approximately 9 mm, a plurality of copper or fiber optic conductors 141, and insulation jackets 142 around each conductor 141. The body 143 of the wireline 140 may comprise a carbon fiber in a resin matrix such as a vinyl-ester epoxy. In one illustrative embodiment, the wireline 140 depicted in FIG. 3 may have a minimum tensile strength of approximately 18,000 pounds, a weight of approximately 0.1 lbs/ft, and a smooth, relatively low friction exterior surface 145. The carbon fiber strength may be much stronger than traditional construction, e.g., the carbon fiber strength may represent nearly a ten-fold strength improvement over its steel core slickline wireline counterpart. The smooth, relatively low friction exterior surface 145 of the wireline 140 shown in FIG. 3 simplifies the packing seal element design of the sealing device 130 (when a stuffing box type design is employed as the sealing device) and reduces residual drag forces (when the wireline 140 is inside the well, laying up against the side of the well's tubing wall).

The small weight per linear foot makes the wireline 140 nearly neutrally buoyant in water and wellbore fluids. This characteristics reduces or eliminates increasing drum tension load associated with a steel slickline and a braided cable which add its weight to the overall tension as more wireline is paid out. Using the composite cable 140 disclosed herein, drum tension capacity may be kept to a minimum regardless of water depth or well depth.

In accordance with one aspect of the present invention, portions of the sealing device 130 are of lightweight construction. For example, portions of the device 130 may be made of a material that has a density less than that of steel (approximately 0.283 lb/in$^3$). In some cases, portions of the sealing device 130 may be comprised of a material having a density that is significantly less, e.g., 10-40% less than that of steel or other like materials. For example, portions of the sealing device 130 may be made of a variety of non-metallic materials, high density molecular weight plastics composites, or other materials having a higher strength-to-weight ratio as compared to carbon steel. Using such a construction along with smaller bore packaging may greatly reduce the weight of the sealing device 130 to less than approximately 5,000 pounds as compared to prior art configurations weighing as much as 20,000-25,000 pounds. Due to the lightweight nature of the sealing device 130 disclosed herein, the sealing device 130 has a degree of buoyancy which reduces its effective weight in water, and more importantly, it may be lowered and retrieved in combination with the wireline tool 150 by the same wireline 140 that is employed in deploying the wireline tool 150, without exceeding the structural tensile strength of the wireline 140. This is particularly true if the wireline 140 has a composite structure similar to that shown in FIG. 3 which may support in excess of 18,000 pounds. Typically, a prior art slickline wireline, as frequently employed in prior art systems, may support approximately 1,000-2,000 pounds during operation. Braided cable and the composite cable wireline 140 disclosed herein in FIG. 3, have additional tensile capacity which may support approximately 7,000-9,000 pounds during operation.

Figure 4D:
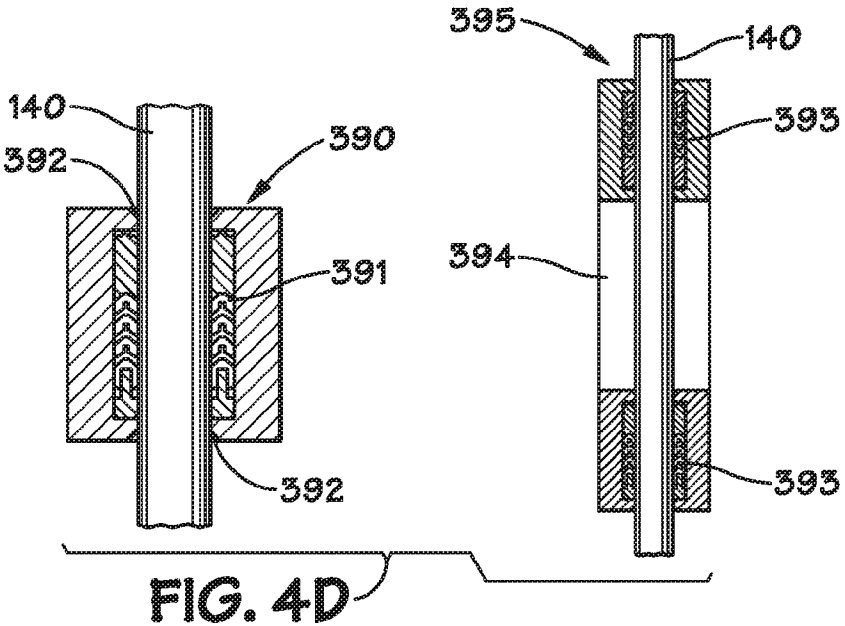
FIGS. 4A-4F depict various views of one illustrative embodiment of a sealing device in accordance with the present invention.
Figure 4A:
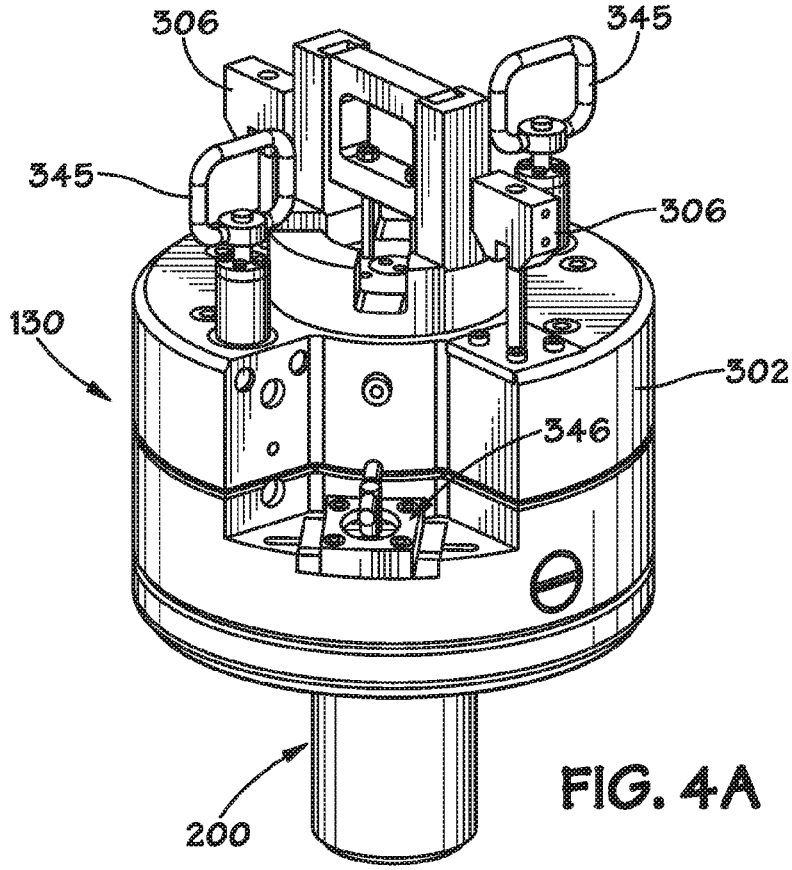
Figure 4E:
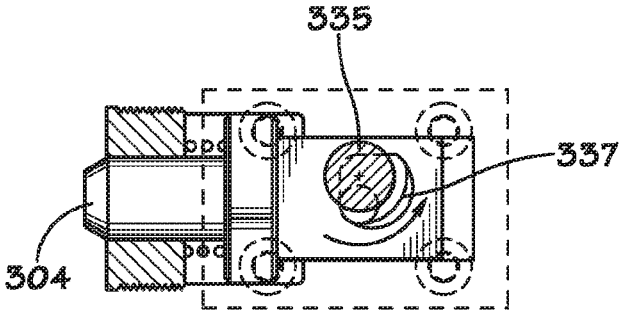
Figure 4F:
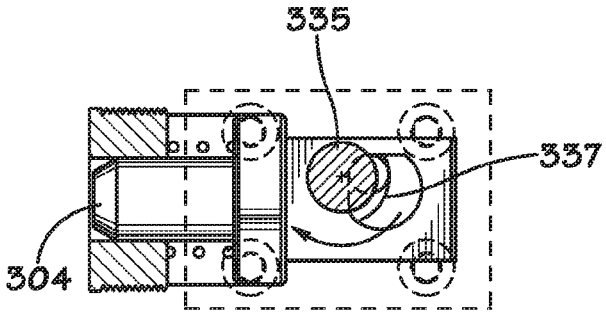
Figure 4B:
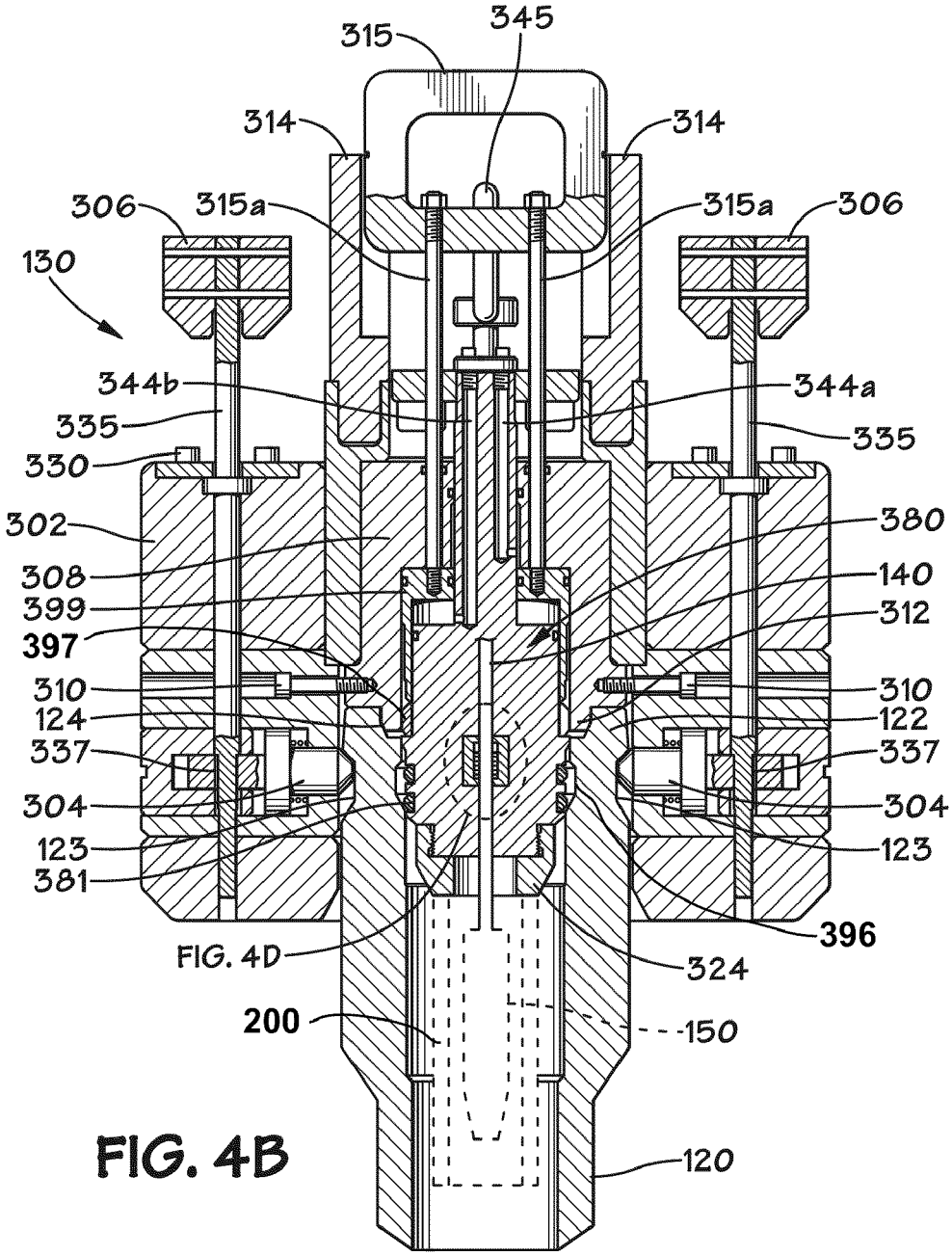
Figure 4C:
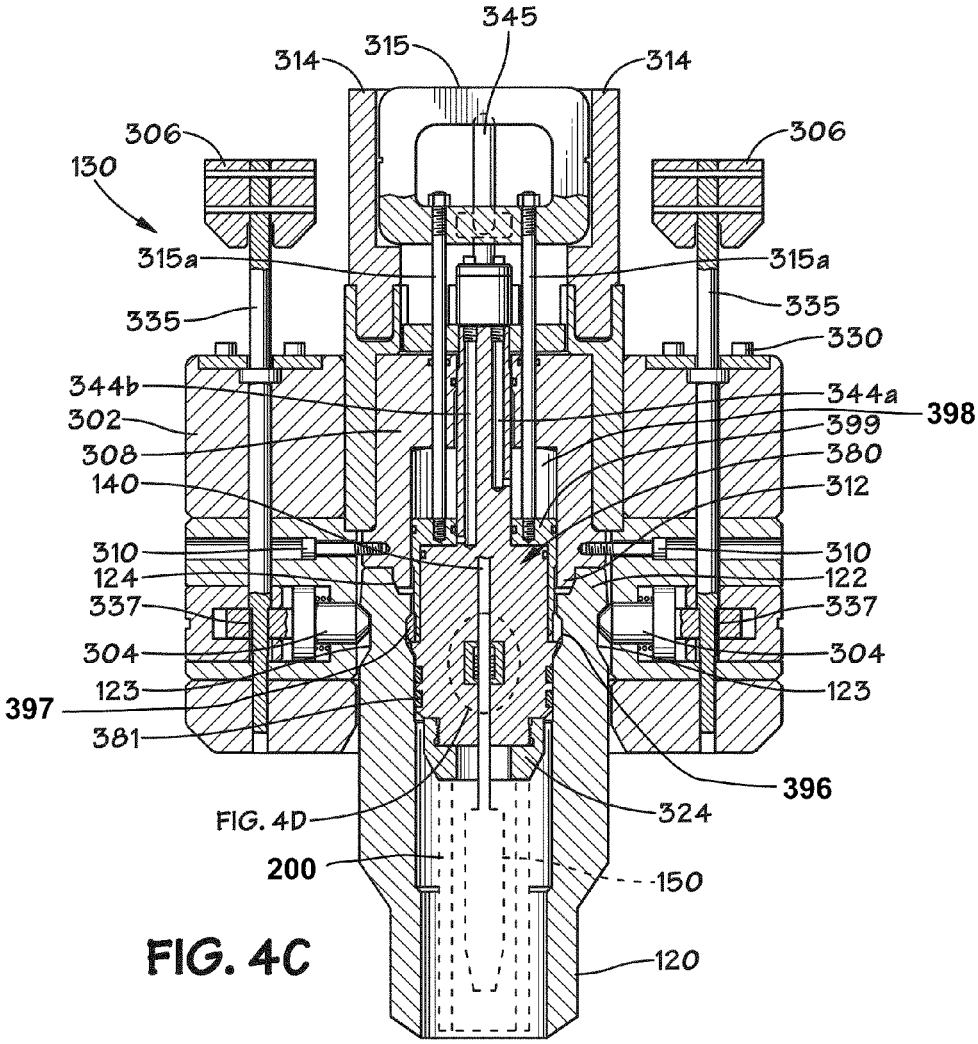

FIGS. 4A-4F depict various views of one illustrative embodiment of a sealing device 130 that may be employed as described herein. FIG. 4A is a perspective view of the illustrative sealing device 130. FIG. 4B is a cross-sectional side view wherein the sealing device 130 is landed and "latched" in place. FIG. 4C is a cross-sectional view of the sealing device 130 wherein the device is fully landed locked and sealed inside the lubricator housing 120. As shown in these drawings, the sealing device 130 is operatively coupled to the upper end 122 of the lubricator housing 120. FIG. 4D is a cross-sectional view of illustrative techniques for sealing the wireline 140 penetration that may be employed with the present invention.

The sealing device 130 comprises a body 302, a plurality of latch pins 304, and a plurality of latch pin release handles 306 that are coupled to rods 335. FIGS. 4E and 4F depict the latch pins 304 in engaged (locked) and disengaged (unlocked) positions, respectively. A camming mechanism 337 is employed to extend or retract the latch pins 304 when the rod 335 is rotated via handles 306. In one illustrative example, the body 302 is securely coupled to a structural member 308 by a plurality of threaded connectors 310. Traditional hardware and threaded connectors 330 are employed to couple the latch pin release handles 306 to the body 302. The handles 306 and latch pins 304 are configured to be mechanically operated by an ROV manipulator. However, other latching means, such as hydraulic actuation, may be employed to lock and seal the sealing device 130 to the lubricator housing 120. The lower end 312 of the structural member 308 sealingly engages the sealing surface 124 on the upper end 122 of the lubricator housing 120. The sealing device 130 further comprises a plurality of dual function hydraulic hot stabs 345, the construction and operation of which are well known to those skilled in the art. An isolation valve 346 (see FIG. 4A), e.g., a needle valve, may also be provided for purposes to be described more fully below.

Also depicted are elongated structures 314, an ROV handle 315, an inner body 380, a nose end cap 324 and lines 344*a*, 344*b* (for purposes of drawing a vacuum or conveying hydraulic fluid). A sleeve 200 (shown in dashed lines) may be provided at the end of the inner body 380. Such a sleeve 200, if provided, may act as a stab to assist in the landing of the sealing device 130 on the end 122 of the lubricator housing 120. The sleeve 200 may also provide protection for the schematically depicted tool 150.

In operation, the sealing device 130 is seated and latched in place (latch keys 304 extended and engaged into a recessed external groove 123 in the upper end 122 of the lubricator housing 120), as shown in FIG. 4B. Then, hydraulic pressure is applied through a line 344*a* to increase the pressure in a cavity 398 (see FIG. 4C) above the inner body 380 and thereby pushes the inner body 380 of the sealing device 130 downward into the bore of the lubricator housing 120, engaging additional seals 381 between the inner body 380 and the bore of the lubricator housing 120, as shown in FIG. 4C. The latch keys 304 provide a reaction point to properly direct the hydraulic induced force downward instead of pushing the sealing device 130 up off of the lubricator housing 120. The source of hydraulic fluid may be supplied from injected pressure from an ROV through the hot stabs 345 or other sources. The inner body 380 may also be moved mechanically by applying the appropriate force to the upper ring handle 315.

In the illustrative embodiment depicted herein, the sealing device 130 also encases an isolation valve 346, e.g., a needle valve, connected between the inner body 380 through a set of lines. When opened, the isolation valve 346 allows passage of sea water or other fluids trapped between the inner body 380 and the bore of the lubricator housing 120, thereby preventing any chance of hydraulic lock. This porting may be employed to generate additional downward force from the sea water's hydrostatic head to push down on the sealing device 130 and seat it on the end 122 of the lubricator housing 120. Once the inner body 380 is fully landed and sealed in the bore of the lubricator housing 120 (as shown in FIG. 4C), the isolation valve 346 may be closed to create the pressure containing environment between the lubricator housing 120 and the sealing device 130. This same operation is repeated to lock the inner body 380 to the interior of the upper end 122 of the lubricator housing 120 by applying hydraulic pressure through line 344*a*, driving down an annular piston 399 which in turn pushes out an expanding ring 397 into a groove 396 in the inside surface of the upper end 122 of the lubricator housing 120. The resultant locked position provides to provide a structural connection that can withstand increased end pressure loads caused by internal pressure from the well.

Conversely, during unlocking and removal of the sealing device 130, a small amount of injected pressure from the ROV into the line 344*b* moves the piston 399 up, allowing the expanding ring 397 to collapse and free the inner body 380 from up and out of the bore of the lubricator housing 120. The sealing device 130 may be mechanically released by upward mechanical force on the upper handle 315. The sealing device 130 and inner body 380 may also be hydraulically pushed up and out of the lubricator housing 120 by opening the isolation valve 346 and allowing sea water to be pumped in through porting to create the necessary upward force. In the depicted embodiment, the body 302 essentially surrounds the structural member 308 and inner body 380. However, if desired, the body 302 could be formed as separate segments, e.g., four ninety degree segments, or other configurations.

In operation, the combination of the light weight sealing device 130 and the wireline tool 150 are lowered toward the well 110 by a single wireline 140. By use of an ROV, a diver and/or a guideline (not shown), the sealing device 130 is landed on the upper end 122 of the lubricator housing 120. An ROV may then be employed to grasp and rotate the handles 306 to thereby engage the latch pins 304 with the profile 123 in the outer surface of the upper end 122 of the lubricator housing 120. In turn, this causes the ends 122 and 124 to sealingly engage one another. Subsequent operation of the upper handle 315 and/or line 344*a* engages the inner body 380 for a higher pressure/structural connection to the interior of the upper end 122 of the lubricator housing 120. The latch pins 304, when locked into the external groove 123 of the upper end of the lubricator body 122, provides the necessary mechanical resistance to oppose the insertion force when sealingly engaging the inner body 380 down into the interior of the lubricator housing 120.

As indicated above, the exact structure of the sealing device 130 may vary depending upon the particular application. As shown in FIGS. 4B, 4C, and 4D, the sealing device 130 is provided with a schematically depicted stuffing box 390 that may be preassembled around the wireline 140 and inserted into the inner body 380. As shown in FIG. 4D, the stuffing box 390 comprises one or more sealing members 391 that have an opening 392 through which the wireline 140 may extend. The stuffing box 390 may be conventional construction and it may be employed to seal around the wireline 140 during operations. For example, the present invention may employ a stuffing box 390 that is similar in construction to the stuffing box designs described in U.S. Pat. Nos. 4,386,783 or 6,105,939, both of which are hereby incorporated by reference in their entirety. Other sealing device configurations may include sealing elements associated with a grease injector head system 395, as depicted schematically in FIG. 4D with an upper and lower sealing elements 393 and a port 394 for injecting grease in between the sealing elements.

Figure 5:
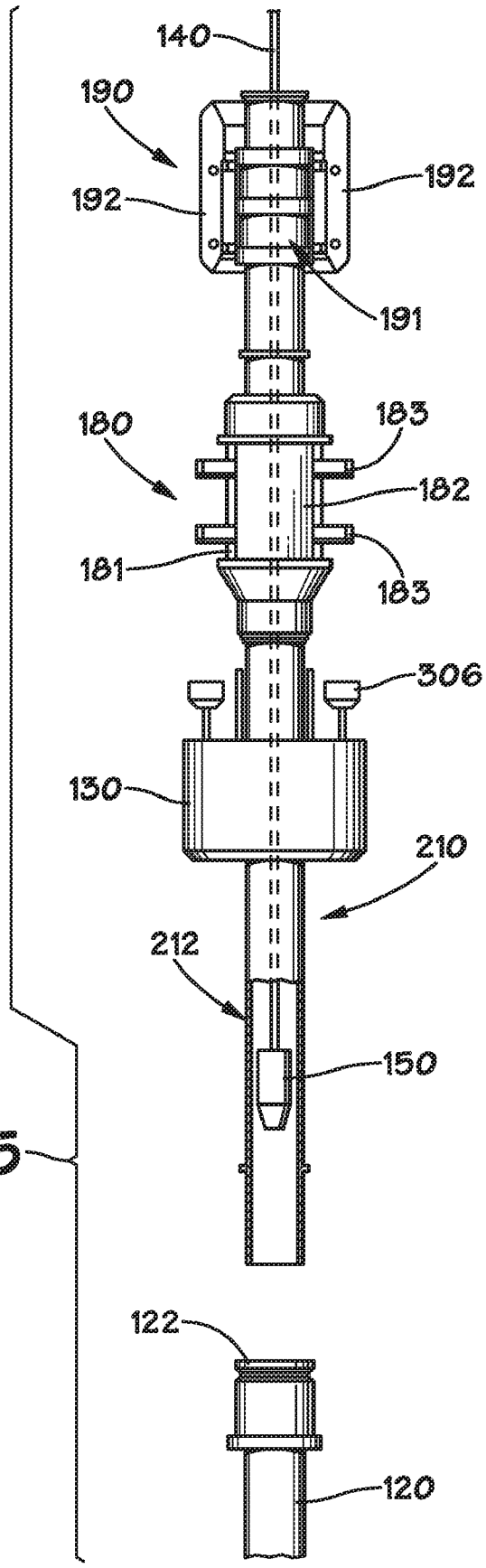
FIG. 5 depicts additional components that may be positioned adjacent the sealing device disclosed herein.

Additional components or features may be combined with or used with the illustrative sealing device 130 disclosed herein. For example, FIG. 5 depicts an illustrative shearing unit 180 that may be positioned above the schematically depicted sealing device 130 shown in FIG. 5. The shearing unit 180 may be formed integrally with the sealing device 130 or it may be a separate component that is connected to the sealing device 130. The shearing unit 180 comprises a generally elongated body 181 that defines a cavity 182. One or more shearing mechanisms (not shown) are positioned within the ram housing 183. The shearing mechanisms and the manner in which they are actuated may be similar to shearing rams commonly found in traditional blow-out preventers (BOPs), the structure and operation of which are well known to those skilled in the art. The shearing unit 180 may be employed where there may exist operational risks where the surface vessel may have to leave its overhead location due to weather or vessel mechanical failure. In some instances this event could occur too quickly to pay out additional wireline line length off the drum. In such a case, the shearing unit 180 may be activated to mechanically sever the wireline 140 to protect subsea hardware (both the LIP and the subsea Christmas tree).

A third component or feature may be added for more precise positioning or applying additional locomotive force to the wireline 140 to assist with the movement of the wireline tool 150 and wireline 140 as they perform intervention operations in the well. For example, FIG. 5 depicts and illustrative injector unit 190 comprising of an elongated body 191 that guides and centralizes the wireline 140 as it traverses through the body 191 and structurally supports a plurality of locomotive devices 192, such as wheels or caterpillar tracks, which engage the exterior of the wireline 140 and provide motive force up or down to pull or push the wireline 140 into or out of the well. The injector unit 190 may be formed integrally with the sealing device 130 and/or shearing unit 180, or it may be a separate component that is connected to the sealing device 130 and/or shearing unit 180.

A fourth component or feature may be added to sealing device assembly which mechanically retains the wireline tool 150 in place while lowering or retrieving the tool and sealing device 130 to or from the lubricator housing 120, then selectively releases the tool so that it can be lowered into the well. This feature is know in the art as a "tool catcher" 210. An illustrative wireline tool 150 is depicted as being positioned within the body of the combined assembly, just below the stuffing box sealing element(s) in the sealing device 130. The tool catcher mechanism 210 features a locking device, such as latch pins, keys, cantilevered locking segments or other locking devices (not shown) that passively connect to a profile on the wireline tool's body that can independently supports and suspends its weight. Conversely, the locking mechanism can be intentionally retracted to allow passage of the wireline tool 150 into the well. In conjunction with the shearing device 180, when actuated, the shearing mechanism will sever the wireline 140 allowing the wireline tool 150 to free fall back down into the well. The tool catcher 210 prevents this free fall from occurring should the shearing operation take place. In an embodiment of the tool catcher 210, the catcher may be configured with a thin elongated body 212 which concentrically fits inside the bore of the lubricator housing 120. In this way the catcher body 212, much like the sleeve 200, provides easier alignment for the tool as the tool and sealing assembly are lowered and aligned with the top of the lubricator housing 120 and provides an element of structural protection around the wireline tool 150 as the entire assembly is lowered down to the subsea assembly 100 or retrieved back to the surface.

Another aspect of the disclosed subject matter will now be discussed with references to FIGS. 6-11. The subject matter disclosed herein provides a flexible approach in such interventions where the length of the lubricator can at all times be tailored to the needs of the operation to be performed. This is achieved by using a plurality of lubricators. In one example, one of the lubricators is a fixed length lubricator that is always attached to an isolation control device, e.g., part of a LIP 116, and the other lubricator is an extension lubricator that can be attached to the fixed lubricator as necessary to provide additional length to accommodate relatively long wireline tools to be used during the intervention.

Figure 6:
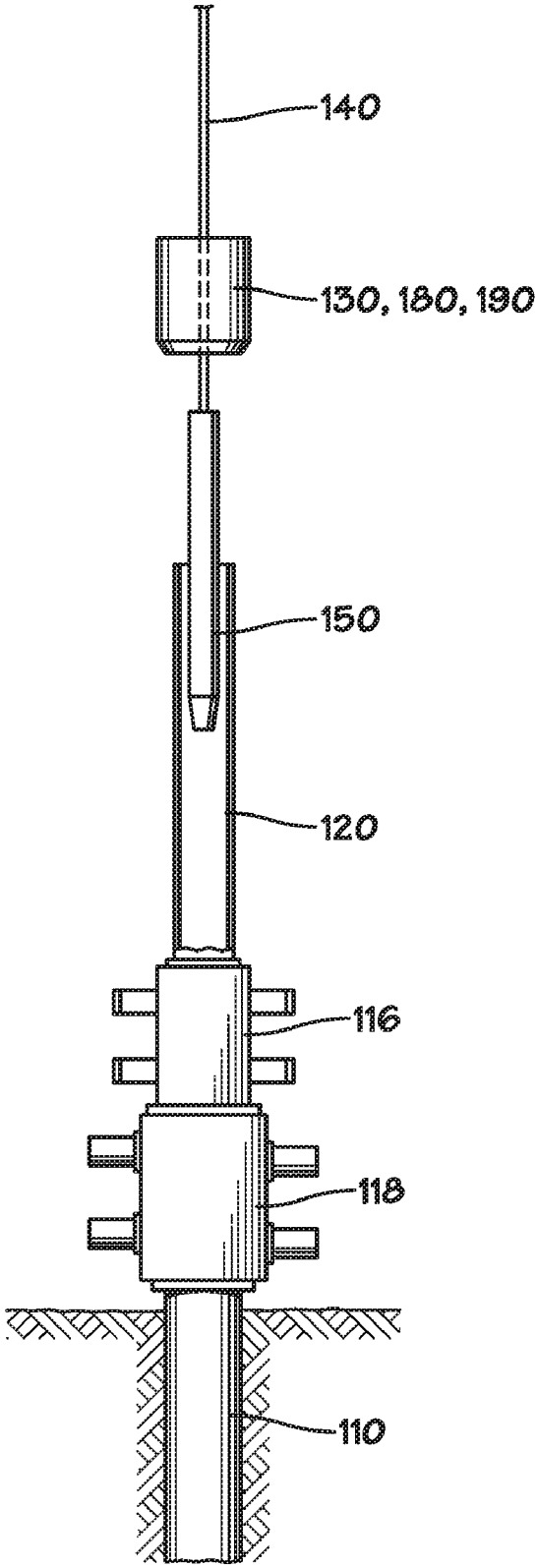
FIGS. 6-9 depict additional aspects of the present subject matter.
Figure 7:
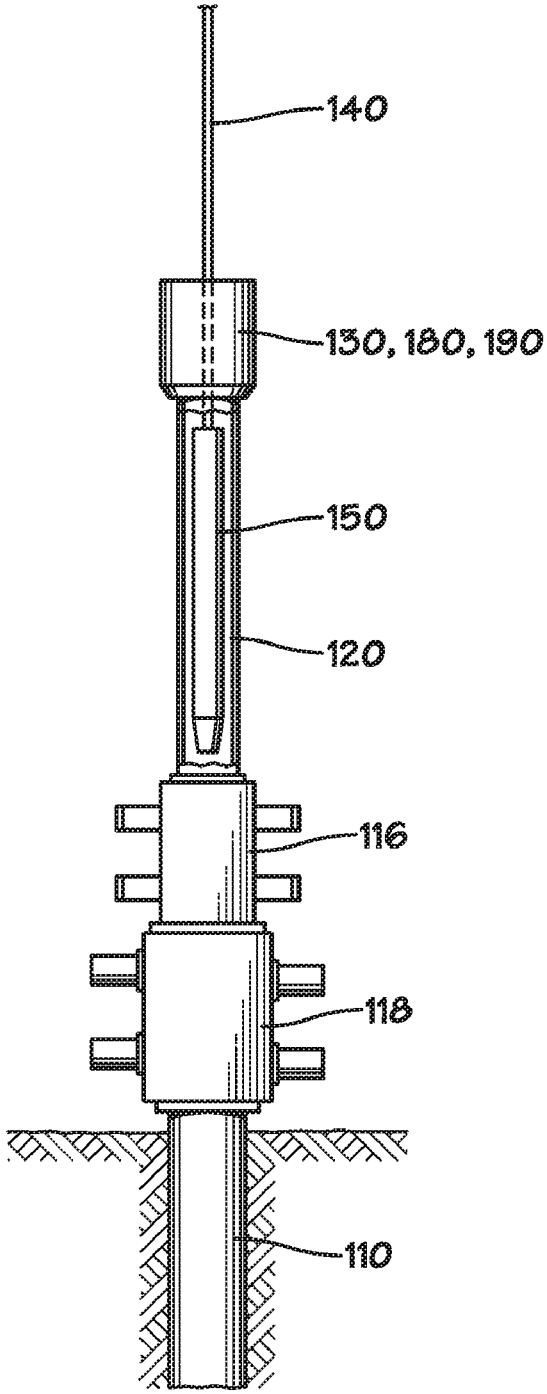

FIGS. 6 and 7 depict how the wireline tool 150 is lowered into the lubricator using the above described embodiments, and generally describes how the wireline tool 150 and PCH 130,180,190, assembly is assembled after connection.

Figure 8:
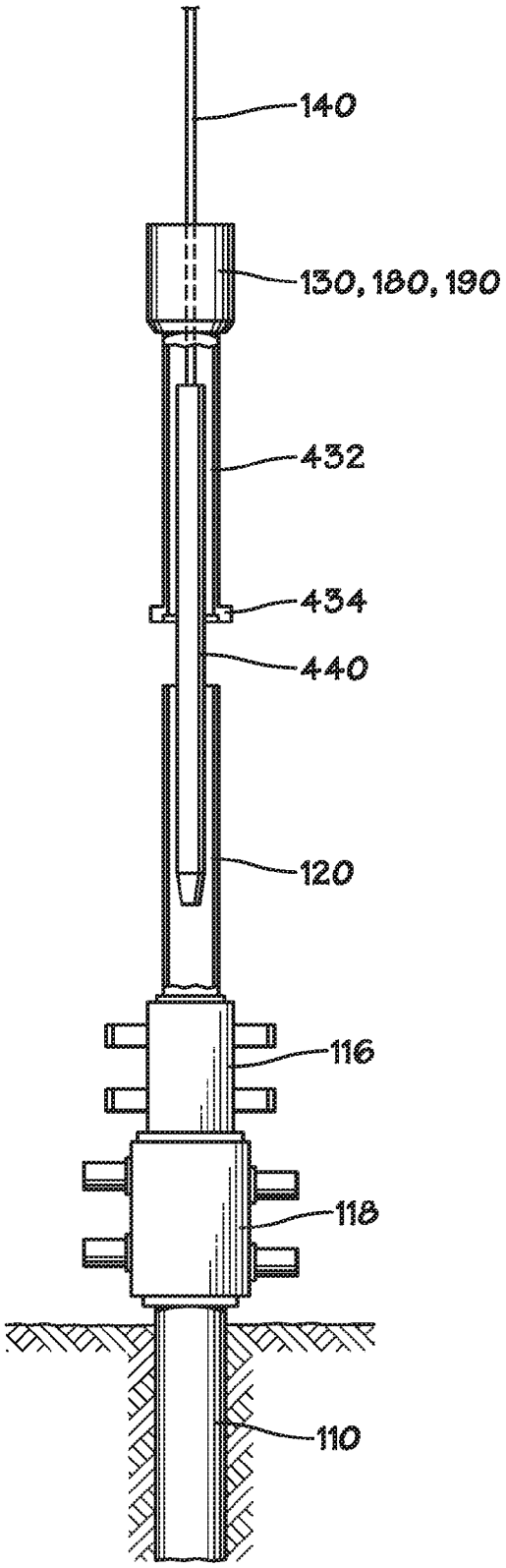
Figure 9:
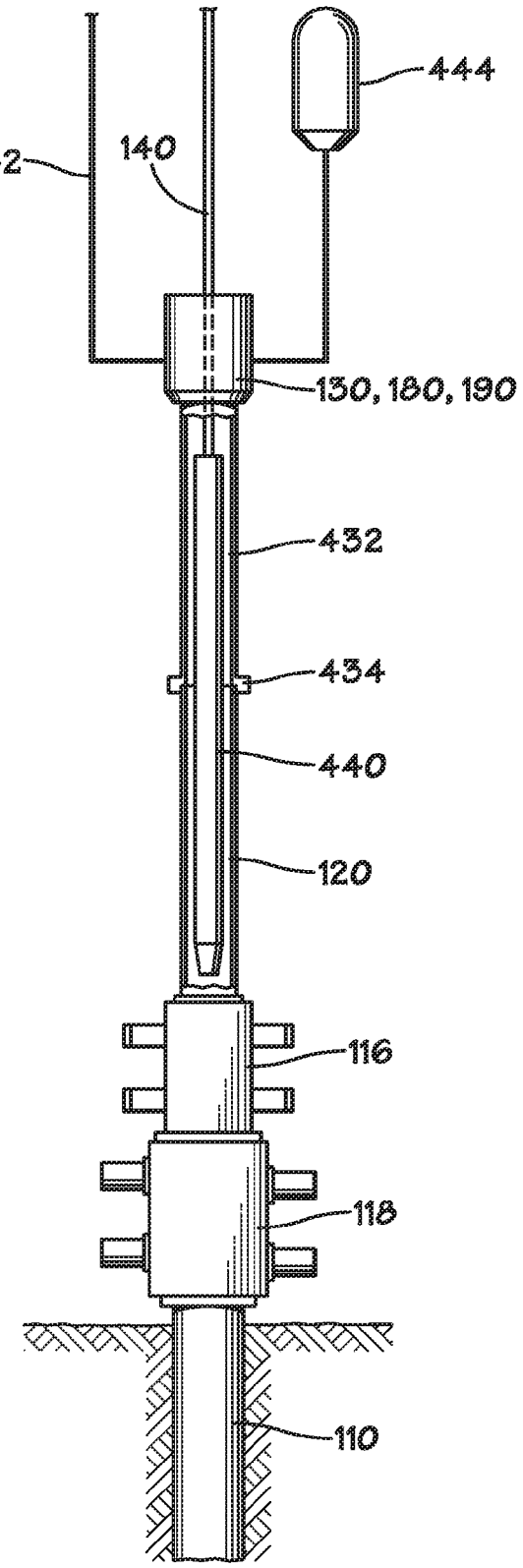

If the intervention operation demands a wireline tool 440 that is longer than the lubricator 120, the present invention proposes the use of an extension pipe 432 to be connected to the lubricator 120, as illustrated in FIGS. 8 and 9. When assembling the PCH 130, 180, 190, wireline tool 440 and cable or wireline 140 at the vessel, a length of pipe 432 is pre-connected to the PCH 130, 180, 190. The length of this extension pipe 432 should enable the lubricator 120 to accommodate the total length of the relatively long wireline tool 440. The extension pipe 432 may have a sealing connector device 434, e.g., a hydraulically or mechanically operated clamp, so that it will match the connection on the top of the lubricator 120,122. The complete assembly is lowered to the well and the tool 440 is inserted into the lubricator 120. Further lowering the assembly makes the extension pipe 432 land on top of the lubricator 120. The lubricator 120 and the extension pipe 432 are then locked together. Operations can now be performed in the well in the same manner as described above. In some embodiments, the connector device may be the illustrative sealing device 130 described above wherein the bore of the device has been increased to accommodate the size of the tool 440.

Alternatively, more than one extension pipe 432 may be in the system. This enables the basic lubricator 120 to be as short as possible and only for use with the smallest tools. This may be the situation when the plugs are pulled from the Christmas tree 118 to enable access to the well. Then, for normal operations, depending upon the length of the tool, the lubricator 120 may only be employed, or one or more extension pipes 432 may be employed as necessary. For example, if it becomes necessary to perform operations using even longer tools, a third extension pipe 432 can be added. However, the length of the lubricator 120 and lubricator extension may become structurally unstable if built too long and subsequently exposed to adverse ocean current conditions. Added tension from wires 442 suspended from the vessel 1 above or some form of buoyancy 444 may be added to improve structural stability to the lubricator 120 and extension pipe 432.

The particular embodiments disclosed above are illustrative only, as the invention may be modified and practiced in different but equivalent manners apparent to those skilled in the art having the benefit of the teachings herein. For example, the process steps set forth above may be performed in a different order or the various components stacked and assembled in different configurations. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A device adapted to be positioned adjacent an end of a tool housing of a subsea lubricator, comprising:

a structural member that is adapted to engage said end of said tool housing;

a non-metallic body coupled to said structural member;

a plurality of latch pins positioned at least partially within said non-metallic body, wherein said latch pins are adapted to, when actuated, engage said tool housing; and a sealing element at least a portion of which is disposed inside a bore of said structural member, wherein said sealing element is adapted to sealingly engage a wireline extending through said sealing element.

2. The device of claim 1, wherein said structural member is further adapted to sealingly engage an inside sealing surface of said end of said tool housing.

3. The device of claim 1, wherein said structural member is comprised of steel.

4. The device of claim 1, wherein said sealing element is positioned at least partially within said structural member.

5. The device of claim 1, wherein said sealing element comprises a stuffing box.

6. The device of claim 1, wherein said sealing element comprises a grease injection system.

7. The device of claim 1, wherein said non-metallic body is comprised of plastic.

8. The device of claim 1, wherein said non-metallic body is comprised of a material having a density of less than 0.283 lbs/in3.

9. The device of claim 1, wherein said non-metallic body surrounds said structural member.

10. The device of claim 1, wherein said non-metallic body is coupled to said structural member by a plurality of threaded connectors.

11. The device of claim 1, wherein each of said latch pins are operatively coupled to ROV actuatable handles.

12. The device of claim 1, wherein said non-metallic body is sized and configured such that the combined weight of the combination of said device and a wireline tool to be lowered with said device is such that the combination of the device and said wireline tool may be lowered toward a subsea Christmas tree using a wireline coupled to said wireline tool.

13. The device of claim 1, further comprising an inner body positioned at least partially within said structural member, said inner body adapted to have at least a portion of said sealing element positioned within said inner body.

14. The device of claim 13, further comprising at least one seal that is adapted to provide a seal between said inner body and an internal bore of said tool housing.

15. The device of claim 13, wherein said inner body is axially moveable relative to said structural member.

16. The device of claim 13, further comprising at least one line for applying pressure to said inner body to cause said inner body to move relative to said structural member.

17. The device of claim 13, further comprising a sleeve extending from an end of said inner body, said sleeve adapted to have a wireline tool positioned therein.

18. A device adapted to be positioned adjacent an end of a tool housing of a subsea lubricator, comprising:

a structural member that is adapted to engage said end of said tool housing;

a non-metallic body coupled to said structural member;

a plurality of latch pins positioned at least partially within said non-metallic body, wherein said latch pins are adapted to, when actuated, engage said tool housing, and wherein each of said latch pins are operatively coupled to ROV actuatable handles; and a sealing element at least a portion of which is disposed inside a bore of said structural member, wherein said sealing element is adapted to sealingly engage a wireline extending through said sealing element.

19. A device adapted to be positioned adjacent an end of a tool housing of a subsea lubricator, comprising:

a structural member that is adapted to engage said end of said tool housing;

a non-metallic body coupled to said structural member;

a sealing element, at least a portion of which is disposed inside a bore of said structural member, wherein said sealing element is adapted to sealingly engage a wireline extending through said sealing element; and an inner body positioned at least partially within said structural member, wherein said inner body is axially moveable relative to said structural member and is adapted to have at least a portion of said sealing element positioned within said inner body.

20. A device adapted to be positioned adjacent an end of a tool housing of a subsea lubricator, comprising:

a structural member that is adapted to engage said end of said tool housing;

a non-metallic body coupled to said structural member;

a sealing element, at least a portion of which is disposed inside a bore of said structural member, wherein said sealing element is adapted to sealingly engage a wireline extending through said sealing element;

an inner body positioned at least partially within said structural member, wherein said inner body is adapted to have at least a portion of said sealing element positioned within said inner body; and at least one line for applying pressure to said inner body to cause said inner body to move relative to said structural member.

21. A device adapted to be positioned adjacent an end of a tool housing of a subsea lubricator, comprising:

a structural member that is adapted to engage said end of said tool housing;

a non-metallic body coupled to said structural member;

a sealing element, at least a portion of which is disposed inside a bore of said structural member, wherein said sealing element is adapted to sealingly engage a wireline extending through said sealing element;

an inner body positioned at least partially within said structural member, wherein said inner body is adapted to have at least a portion of said sealing element positioned within said inner body; and a sleeve extending from an end of said inner body, said sleeve adapted to have a wireline tool positioned therein.

* * * * *